US008443806B2

(12) United States Patent
Morelli et al.

(10) Patent No.: US 8,443,806 B2
(45) Date of Patent: May 21, 2013

(54) FACE PIECE SEAL CHECK DEVICE

(75) Inventors: Paul Morelli, West Greenwich, RI (US); Nino Granatiero, East Greenwich, RI (US); Joseph Rodrigues, Smithfield, RI (US)

(73) Assignee: Honeywell International Inc., Morristown, NJ (US)

( * ) Notice: Subject to any disclaimer, the term of this patent is extended or adjusted under 35 U.S.C. 154(b) by 920 days.

(21) Appl. No.: 11/992,795

(22) PCT Filed: Sep. 30, 2005

(86) PCT No.: PCT/US2005/035345

§ 371 (c)(1), (2), (4) Date: Jan. 29, 2010

(87) PCT Pub. No.: WO2006/118599

PCT Pub. Date: Nov. 9, 2006

(65) Prior Publication Data

US 2010/0132714 A1 Jun. 3, 2010

Related U.S. Application Data

(60) Provisional application No. 60/675,994, filed on Apr. 29, 2005.

(51) Int. Cl.
*A62B 18/10* (2006.01)

(52) U.S. Cl.
USPC ..... 128/207.12

(58) Field of Classification Search
USPC ..... 128/207.12, 206.15, 202.27, 206.17, 128/205.27, 206.21; 251/90; 73/40; 220/203.04, 220/203.07
See application file for complete search history.

(56) References Cited

U.S. PATENT DOCUMENTS

| | | | |
|---|---|---|---|
| 3,805,778 | A | 4/1974 | Garrahan |
| 4,219,017 | A | 8/1980 | Shamlian et al. |
| 4,373,520 | A | 2/1983 | Arbique |
| 4,378,011 | A | 3/1983 | Warncke et al. |
| 4,428,392 | A | 1/1984 | Jones et al. |

(Continued)

FOREIGN PATENT DOCUMENTS

| | | |
|---|---|---|
| WO | WO02099322 | 12/2002 |

OTHER PUBLICATIONS

International Search Report (ISR) and Written Opinion, mailed Jun. 1, 2006 in underlying international application No. PCT/US05/035345; and.

(Continued)

*Primary Examiner* — Theodore Stigell
*Assistant Examiner* — Brooke Matney
(74) *Attorney, Agent, or Firm* — Abelman, Frayne & Schwab

(57) ABSTRACT

A sealing device for positive pressure testing is attached to a respirator face mask and includes an outer frame integrally joined to a movable cap by a flexible link that biases the cap in an open position for the operational use of the face mask against a manually applied force to move the cap to a sealed position for the positive pressure testing to assure the proper fit of the face mask on the wearer. The method for positive pressure testing includes flexibly moving the sealing device from the open position to the sealing position such that the sealing surface of the cap seals the exhalation valve assembly closed. The wearer then exhales into the mask to test the seal of the mask. When the test is completed, the sealing device is released and the inherent biasing force moves the cap from the sealing position to the open position.

22 Claims, 5 Drawing Sheets

U.S. PATENT DOCUMENTS

| | | | |
|---|---|---|---|
| 4,537,189 | A | 8/1985 | Vicenzi |
| 4,574,799 | A | 3/1986 | Warncke |
| 4,850,346 | A | 7/1989 | Michel et al. |
| 5,062,421 | A | 11/1991 | Burns et al. |
| 5,086,768 | A | 2/1992 | Niemeyer |
| 5,092,325 | A | 3/1992 | Ainscough |
| 5,251,618 | A | 10/1993 | Christianson |
| 5,299,448 | A | 4/1994 | Maryyanek et al. |
| 5,732,695 | A | 3/1998 | Metzger |
| 5,839,436 | A | 11/1998 | Fangrow, Jr. et al. |
| 6,102,040 | A | 8/2000 | Tayebi et al. |
| D495,797 | S | 9/2004 | Guney et al. |
| 7,686,017 | B2 | 3/2010 | Taylor |
| 2002/0078953 | A1 | 6/2002 | Fecteau et al. |
| 2002/0195109 | A1 | 12/2002 | Mittelstadt et al. |
| 2004/0079373 | A1 | 4/2004 | Mukaiyama et al. |
| 2005/0109343 | A1 | 5/2005 | Flanningan et al. |
| 2005/0199237 | A1 | 9/2005 | Lurie |

OTHER PUBLICATIONS

International Preliminary Report on Patentability issued Oct. 30, 2007 by the International Bureau of WIPO in counterpart PCT application No. PCT/US2005/035345.

FIG. 1
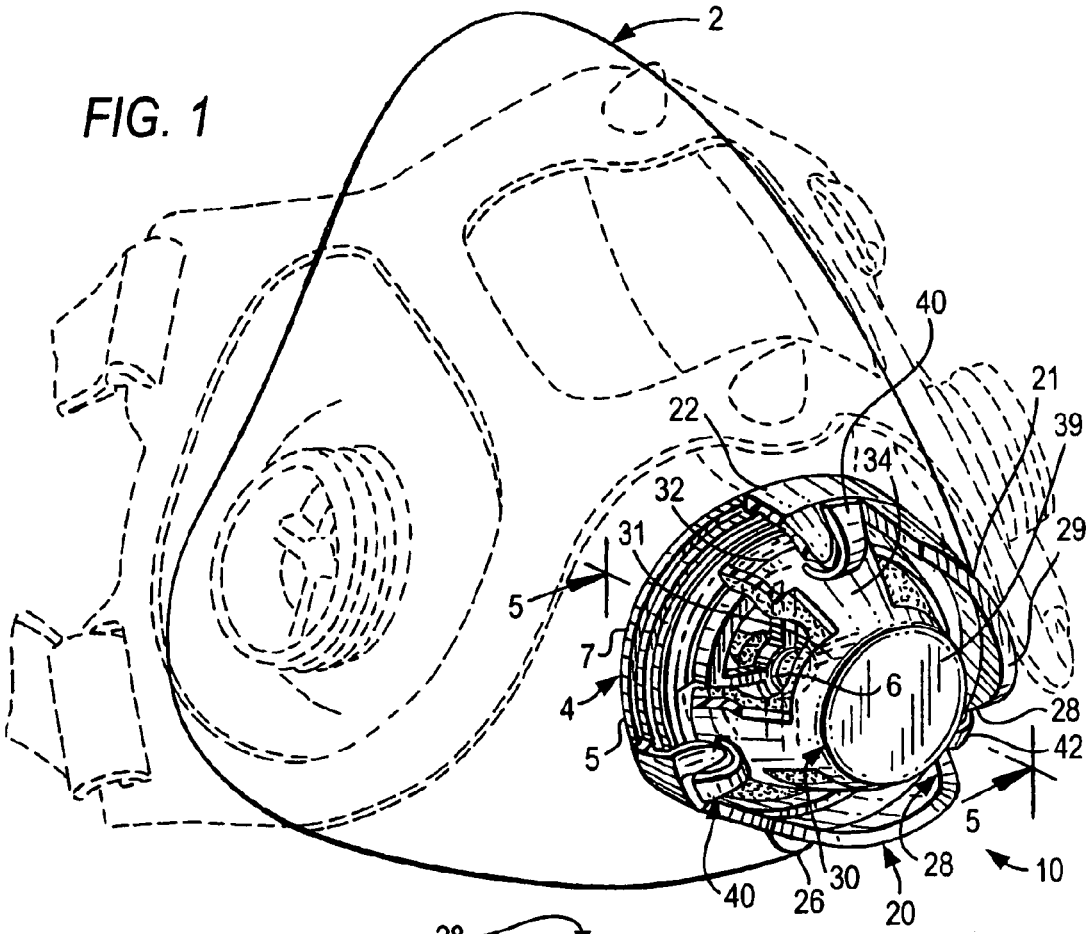
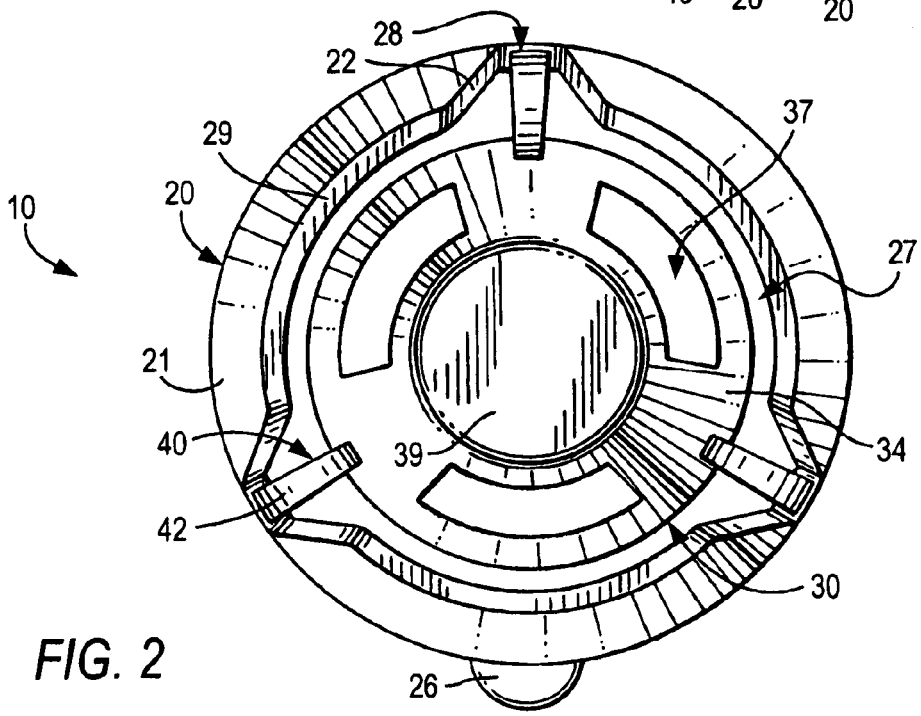
FIG. 2

FIG. 7
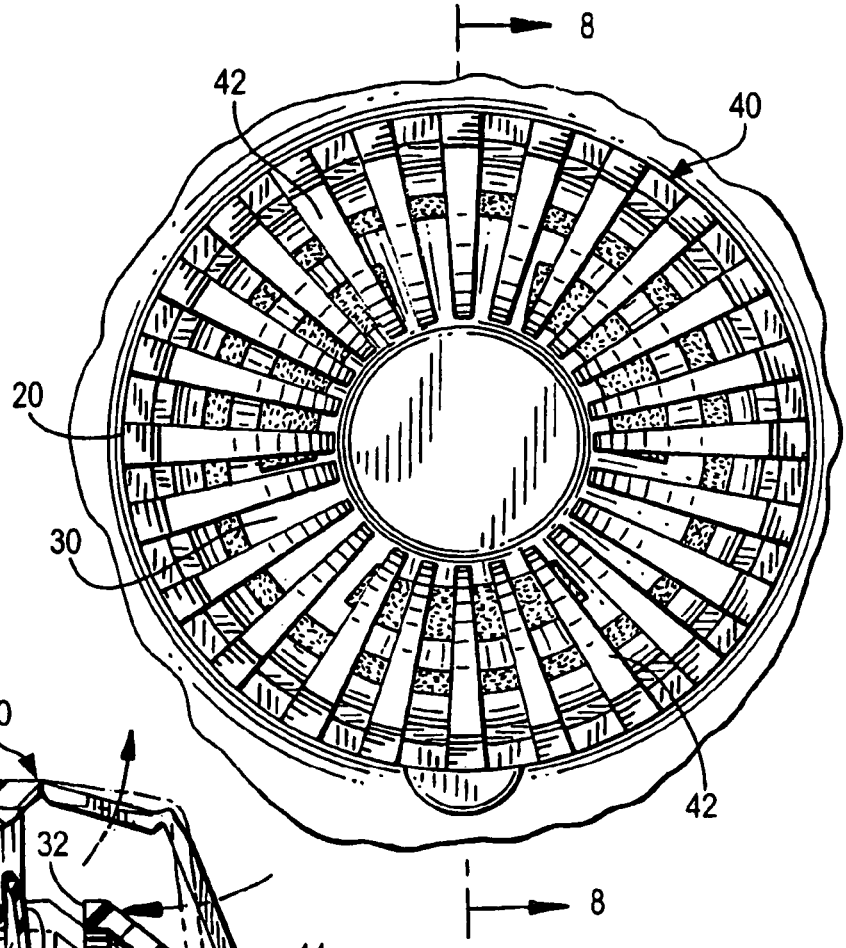
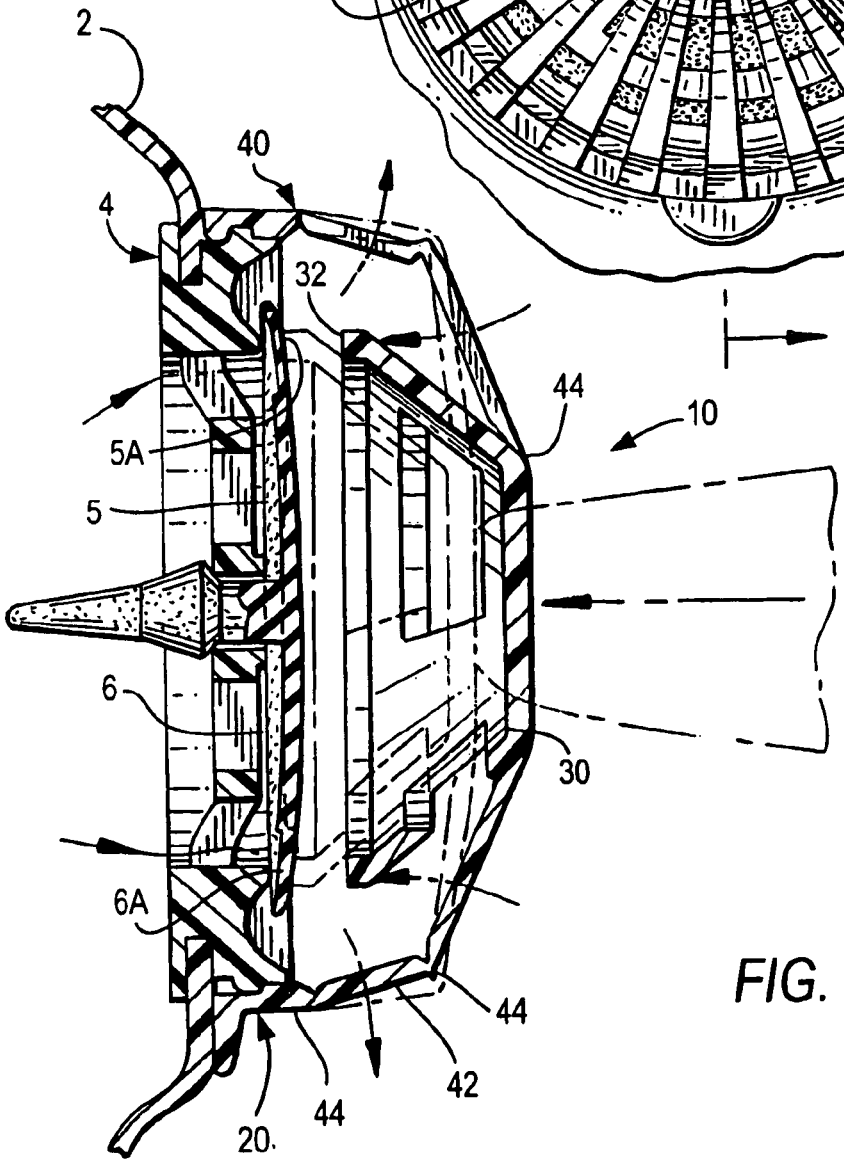
FIG. 8

FIG. 9
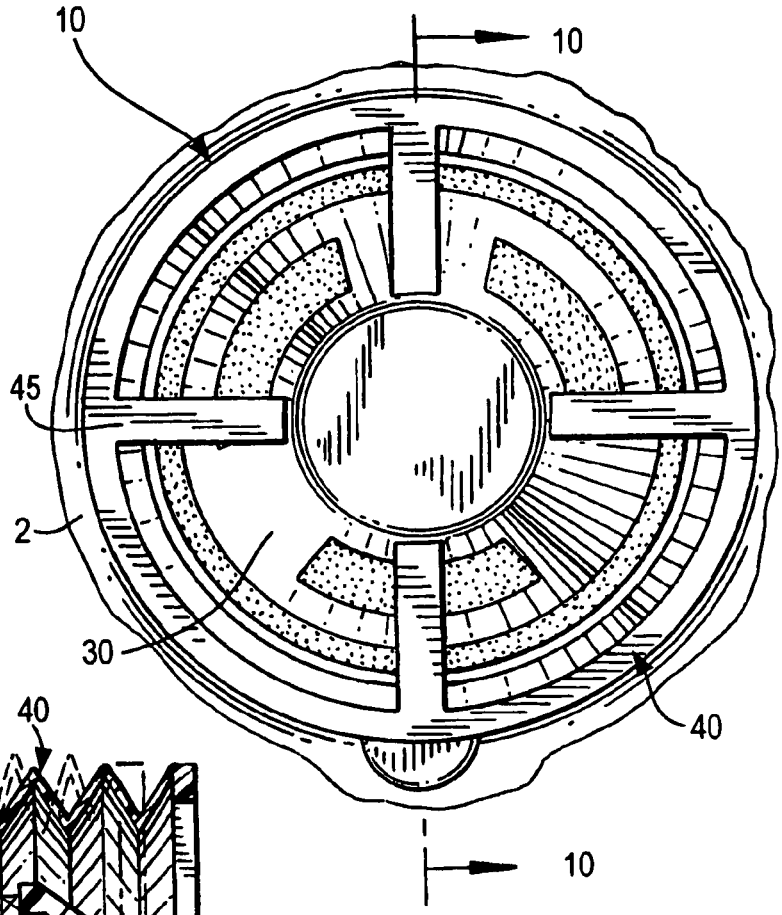
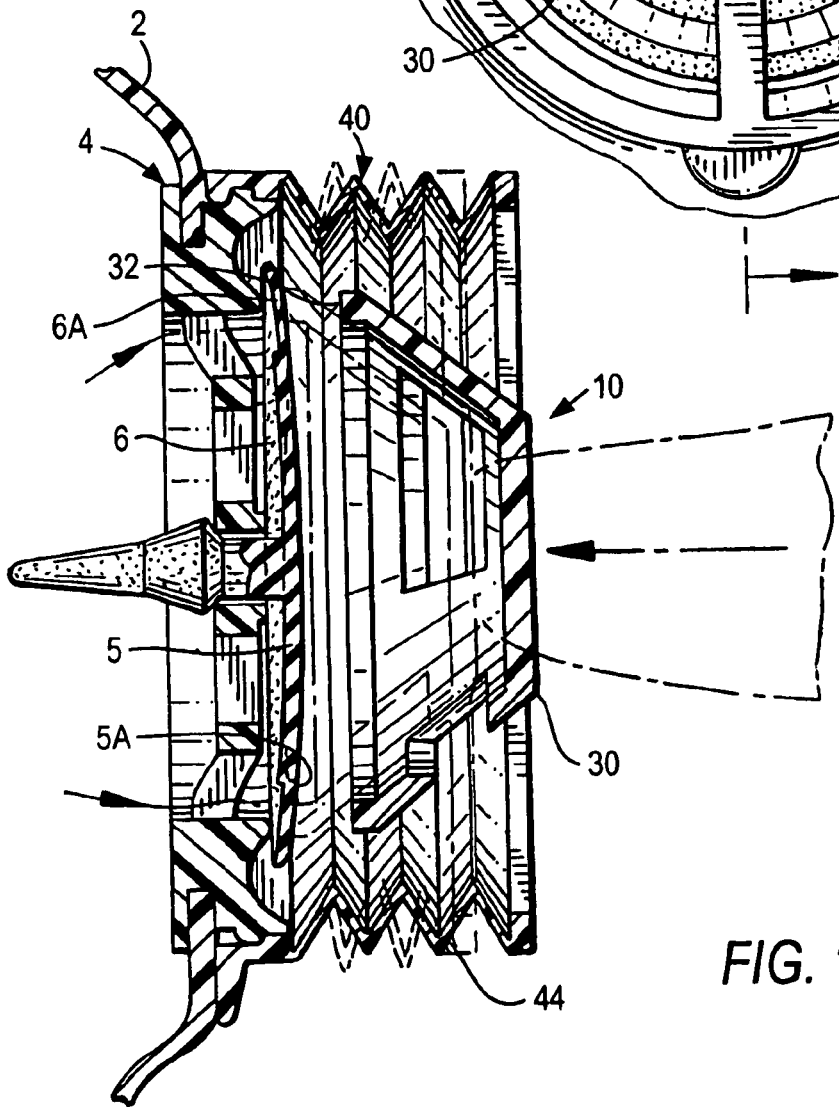
FIG. 10

FACE PIECE SEAL CHECK DEVICE

CROSS-REFERENCE TO RELATED APPLICATIONS

This application is a 371 of PCT/US2005/35345, filed Sep. 30, 2005, which claims benefit of provisional application No. 60/675,994, filed Apr. 29, 2005, both of which are incorporated herein by reference and made a part of this application.

FIELD OF THE INVENTION

This invention relates to devices and methods for testing the seal of a protective face mask having an exhalation valve and specifically to a valve sealing device and method for the positive pressure testing the fit of a face mask.

BACKGROUND OF THE INVENTION

Protective face masks are used in a broad range of industrial and home applications that can include protecting a wearer's respiratory system from airborne particles and a full-face mask that also protects the wearer's face and eyes. Masks of this class are fitted with flexible flap valves to control the flow of air into and out of the mask. The mask is initially placed on the wearer's head and the retaining straps are adjusted as required to comfortably seal the mask against the wearer's face. The wearer then tests the integrity of the seal provided by the face mask before entering into a contaminated area or using hazardous materials by a method such as a positive pressure test.

One technique for the positive pressure testing of the integrity of the seal of the face mask is for the wearer to block the passage of air through the exhalation valve and then exhale into the mask. While the test response of individual masks can vary, a proper fitting mask should produce a high internal pressure. If the wearer feels a flow of air at one or more release points without first experiencing a significant build-up of pressure inside the mask, the fit is not proper. If the face mask seal passes the test, the wearer unblocks the exhalation valve and is ready to use the mask. When a sealing test failure occurs, the wearer must adjust the fit of the face mask and perform the test again until the test is successfully completed.

With some mask configurations, placing the palm of the hand over the exhalation valve outlet can prevent passage of air through the flap valve and the seal of the face mask respirator can be properly tested. In many instances due to the construction of the mask and exhalation valve, the testing of the integrity of the seal of the mask on the wearer cannot be reliably performed without the assistance of a separate device that temporarily seals the exhalation valve closed during the test. This is due to factors such as the placement of the exhalation valve in the facepiece respirator, the type of exhalation valve, the risk of contamination to the exhalation valve and the degree of protective clothing worn by the wearer. For example, if the wearer has also donned protective gloves, the wearer's ability to manually test the integrity of the seal of the face mask can be inhibited by the lack of tactile sensation and the inability to form an airtight seal over the exhalation valve.

In U.S. Pat. No. 5,299,448 to Maryyanek et al., a positive pressure test apparatus 10 for a facepiece respirator having a flexible flap valve is disclosed that includes a cover 12, a central bore 14 and a plunger 18. Plunger 18 includes a button portion 22 and an opposed flange portion 24 that are connected by a stem 20. Plunger 18 is positioned for movement along the central bore 14 in cover 12. Cover 12 encloses flange portion 24 and defines a plurality of vents 29. Flange portion 24 has a frusto-conical shape designed to cover the effective area of fluid communication through the exhalation valve. Flange portion 24 includes a base or sealing interface that has a diameter that is shown in FIGS. 1A, 1B and 2 as well as being described in Example 1, that is significantly larger than the diameter of central bore 14. Button 22 extends out from cover 12 in the rest position and is pushed inwardly until flush with a surface 26 of cover 12 in the depressed position.

Thus, the prior art apparatus has a rest position where the exhalation valve is open and a depressed position where flange portion 24 seals the exhalation valve. A biasing means 28 engages button portion 22 and a shoulder in central bore 14 and biases test apparatus 10 to the rest position. Flange portion 24 seals the area of the exhalation valve in the facepiece respirator when button portion 22 is depressed.

This prior art apparatus is limited by the interface between the rim of the frusto-conical flange element and the facepiece respirator to maintain a complete seal around the effective area of the exhalation valve and also by safety considerations. Maintaining the seal requires the proper angular orientation of the frusto-conical flange base relative to the exhalation valve. Depending upon the materials used in apparatus 10 and the exhalation valve, the flexing of stem 20 or cover 12 as a result of the downward pressure by the wearer to depress button 22, could angularly distort central bore 14 and cause a breach of the intended sealing interface. Further, apparatus 10 is a complex device that is dependent upon separate biasing means 28 positioned in the central bore to disengage button 22 from the depressed position, flush with the surface 26 of cover 12, to the rest position, where it projects outwardly from surface 26. Thus, if plunger 18 were to jam in the depressed position, the wearer could not manually access button 22 in order to break the seal of the exhalation valve.

It is therefore a principal object of the invention to provide an improved face mask positive pressure test sealing device that is reliable and that cannot be inadvertently locked in a sealed position.

It is another object of the invention to provide a face mask positive pressure test sealing device that can be activated when the wearer is under physically restrictive circumstances, such as when the wearer has on protective clothing and gloves.

Another object of the invention is to provide a test device that is economical to manufacture, does not require assembly and can be employed on masks of varying styles and designs.

SUMMARY OF THE INVENTION

The above objects and other advantages are provided by the improved face mask positive pressure test sealing device of the invention that comprises an outer frame, a movable sealing cap and a flexible link or connector. The flexible link connects the outer frame and cap and resiliently flexes or bends to provide the movement of the cap relative to the outer frame between a first open position for the operational use of the face mask and a second sealed position for positive pressure testing of the mask. The cap includes a sealing surface that is preferably shaped to seal the exhalation valve assembly by pressing the flap valve against the flap valve seat in the sealing position. In a preferred embodiment, the periphery of the flap valve is contacted by the sealing surface.

The face mask in the preferred embodiment includes an exhalation valve assembly that has a collar that structurally supports the valve seat. The sealing device can be attached to the collar, exhalation valve assembly harness and/or face mask, but is preferably removably attached to the exhalation valve seat collar. When connected to the exhalation valve seat collar, the sealing device is aligned with the central longitudinal axis of the exhalation valve assembly.

The exhalation valve assembly is preferably a flap valve assembly having a round or disc-shaped flexible flap positioned external to the face of a valve seat. The valve seat includes one or more apertures for the passage of air and vapor exhaled by the wearer. The flap valve seals the one or more apertures positioned in the exhaust valve seat when at rest. When the wearer exhales, the air passes under pressure through the apertures in the valve seat and flexes the flap valve away from the face of the valve seat to permit air to pass from the mask.

The outer frame of the sealing device has a wall that includes a first end that is preferably joined to the collar of the exhalation valve assembly and an opposed second end that can include side portions. The outer frame can connect to the face mask by any type of connection, but is preferably a snap-fit connection for ease of installation and removal of the sealing device. The wall can be continuous or separated into side portions by one or more notches and preferably has an overall inwardly tapered conical shape defining an aperture that is aligned with the central longitudinal axis.

As illustrated in the attached drawings, the sealing device is general cylindrical with a circular cross-section. It is to be understood that square or other rectangular or curvilinear cross-sections can be employed with a corresponding mounting collar of the valve assembly.

The movable cap of the sealing device has a distal top opposed to the proximal sealing surface. The cap is movably positionable between the first position in which the cap is positioned relative to the frame for the operational use of the exhalation valve assembly and the second position wherein the cap is positioned to seal the exhalation valve assembly closed. The cap preferably has a plurality of apertures that accommodate the flow of exhalation from the valve assembly when in the first open position.

The sealing surface of the cap seals the exhalation flap valve against the valve seat in the sealing position. In one preferred embodiment, the exhalation valve assembly includes a flexible round or disc-shaped flap valve connected to a corresponding round valve seat. The flap valve preferably includes a first surface having a circular edge portion for contacting a face of the valve seat. The sealing surface of the cap is preferably shaped to correspond to, and contact the circumferential edge of the flap valve and position the flap valve on the valve seat. The size of the border areas of the flap valve and valve seat can vary in relation to the sealing surface of the cap and the particular sealing device. With the exhalation valve in the sealing position, the sealing surface provides an air-tight seal against the positive pressure developed inside the mask during exhalation.

The flexible link in one preferred embodiment has three flexible radially aligned link elements in the form of elongated strips connected on opposed ends to the frame and cap. The flexible elements preferably have an arcuate shape along a radial cross-section that flex under pressure, such as the manual pressure of a finger or hand, when the cap is moved from the open position to the sealing position. When the manual pressure retaining the cap in the sealed position is released, the cap is biased by the flexible link to move the cap from the sealed position to the open position where the cap does not interfere with the operational use of the mask.

The flexible link can also be formed as a single continuous flexible element extending between the cap and outerframe for operation in a manner analogous to a conventional toilet plunger. The flexible link can include one or more flexible link elements that can vary in radial width, length and thickness.

The movement between the open position and the sealing position can be along the longitudinal axis, at least partially along the longitudinal axis and/or independent thereof. Whatever path of movement is employed, in the sealing position, the sealing surface of the cap is in contact with the exhalation valve assembly to securely seal the exhalation flap valve against the valve seat.

The method of positive pressure testing a face mask using the sealing device of the invention permits the wearer after positioning and adjusting the face mask for a proper fit, to easily and conveniently depress the cap manually with a bare or gloved hand or finger from the first open position to the second sealing position.

The face mask seal is tested by the wearer exhaling into the face mask with the sealing device in the sealing position and evaluating whether the face mask has established a seal with the face and/or head of the wearer. If the mask is adjusted to fit properly and meets the acceptable test criteria for the face mask, the wearer releases the cap and the cap returns to the open position for the operational use of the mask. If the mask does not exhibit an acceptable response to the positive pressure test, the wearer releases the cap from the sealing position, the cap returns to the open position and the wearer adjusts the fit of the mask. The wearer then repeats the positive pressure test as described until a proper fit is obtained.

BRIEF DESCRIPTION OF THE DRAWINGS

Preferred embodiments of the invention are described below with reference to the drawings, wherein like numerals are used to refer to the same or similar elements, and:

FIG. 1 is a front and side perspective view, partially in section, of one embodiment of a positive pressure test sealing device of the invention in an open position assembled to a half-face mask with the retaining straps shown in phantom;

FIG. 2 is a front elevation view of the sealing device of FIG. 1 in the open position;

FIG. 7 is a top plan view of an alternative embodiment of the sealing device of FIG. 1 having a plurality of flexible link elements connecting the cap and an outer frame of the test sealing device;

FIG. 8 is a cross-sectional side elevation view taken along lines 8-8 of the device of FIG. 7 illustrating the movement of the cap and flexible link between the open and sealing positions;

FIG. 9 is a top plan view of another embodiment of the test sealing device of FIG. 1 having a single continuous flexible link element; and FIG. 10 is a cross-sectional side elevation view taken along lines 10-10 of the test sealing device of FIG. 9 showing the movement of the cap and flexible link between the open and sealing positions.

DETAILED DESCRIPTION OF PREFERRED EMBODIMENTS

Figure 4:
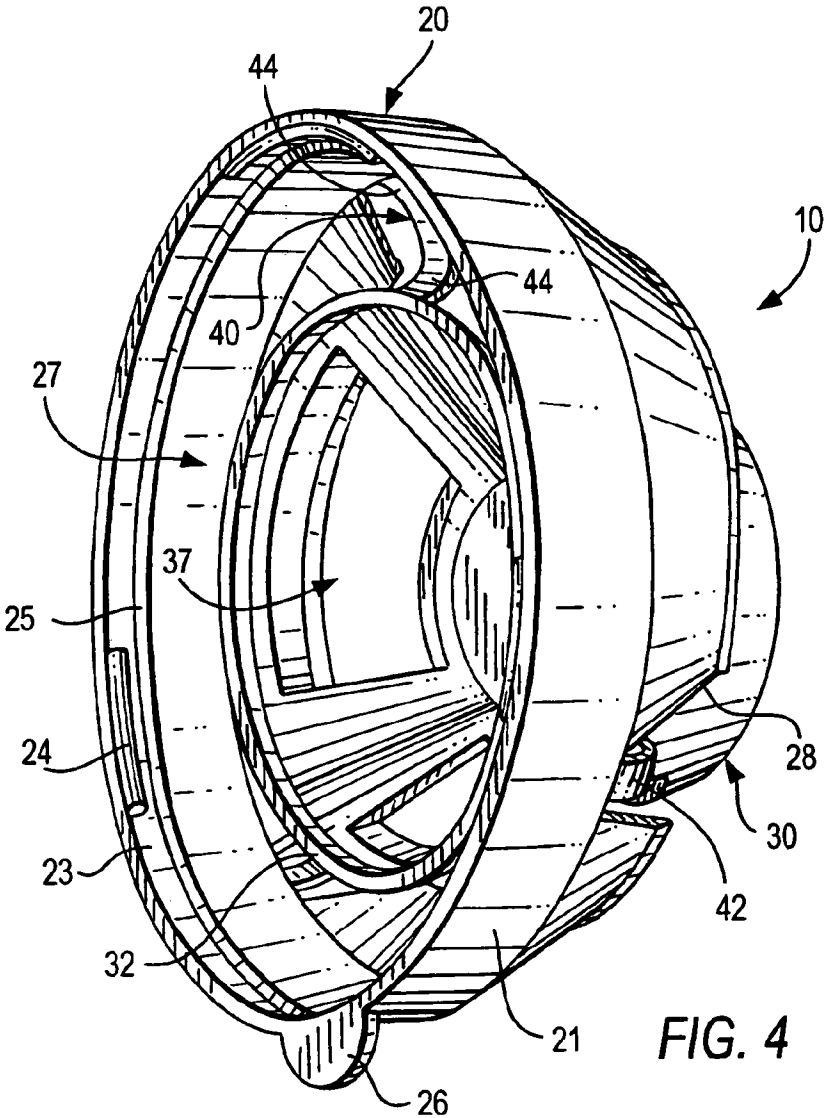
FIG. 4 is a rear and side perspective view of the sealing device of FIG. 2.

With reference to FIG. 1, a positive pressure test sealing device 10 is shown operatively attached to the exhalation valve assembly 4 of a protective face mask 2. Sealing device 10 in this preferred embodiment includes a generally cylindrical outer frame 20, a movable cap 30 and a flexible link 40 that connects cap 30 to outer frame 20 for movement along a central longitudinal axis-X between the first or open position, best shown in FIG. 5, and the second or sealing position, shown in FIG. 6. Exhalation valve assembly 4 and sealing device 10 when joined have aligned central longitudinal axes.

Face mask 2 can be any type of mask with an exhalation valve assembly 4, such as a partial face mask 2, as shown in FIG. 1 or a full face mask (not shown). Exhalation valve assembly 4 includes a flap valve 5, a valve seat 6 and an externally extending collar 7.

Sealing device 10 is preferably formed as an integrally molded article. This unitary construction provides for rugged, damage-resistant characteristics and permits easy removal for access to the flap valve, and replacement, should that become necessary. The device can be efficiently and economically produced by injection molding using suitable polymers, such as polyvinyl chloride monomers and copolymers, polyethylene, polypropylene, styrene copolymers such as ABS, and others known to be useful by those of ordinary skill in the art. Single or multiple-cavity molds can be used. It is to be understood that sealing device 10 can also be fabricated from using other methods and various combinations of other polymers, or from metal and/or composite materials into an integrally formed component.

As shown in FIGS. 1 and 2, frame 20 is removably attachable to and defines a corresponding aperture 27 with exhalation valve assembly 4. In the embodiment illustrated, the cross-section of the valve assembly 4 and device 10 is circular, and device 10 is mounted externally in close-fitting relation. Other shapes and mounting means will be apparent to those of ordinary skill in the art.

Frame 20 has an annular shape with a wall 21 including a proximal edge 22 and an opposed distal edge 29. Wall 21 preferably forms a generally inwardly tapered conical shaped portion of frame 20 that defines three extended and slightly inwardly inclined side portions.

Figure 3:
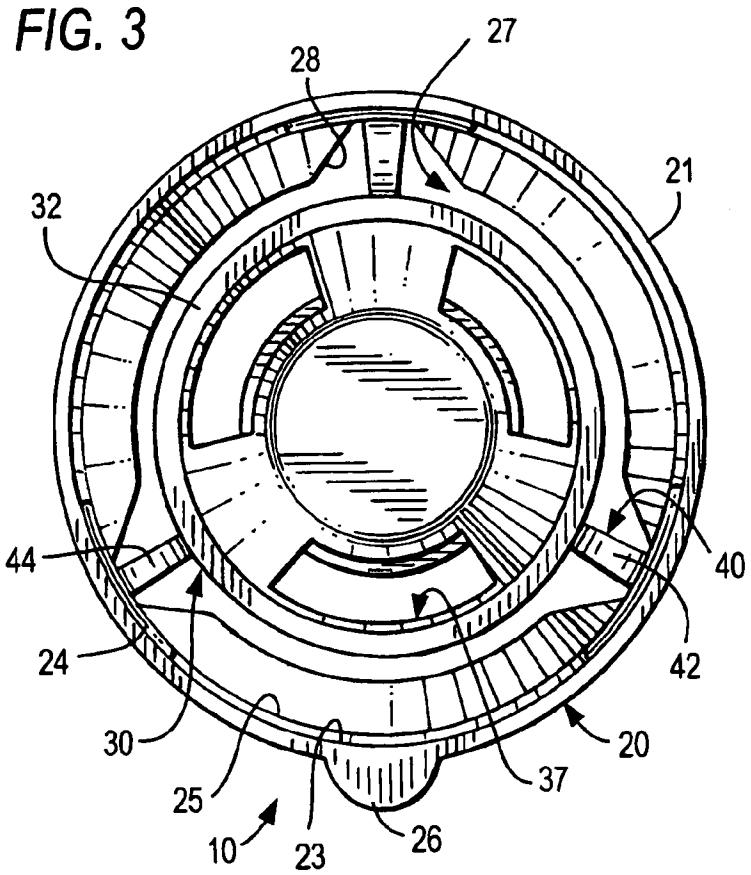
FIG. 3 is a rear view of the sealing device of FIG. 2.

As shown in FIGS. 1, 3 and 4, wall 21 of outer frame 20 in the preferred embodiment includes an area of reduced thickness 23 in proximity to proximal edge 22 that interfaces with collar 7 of face mask 2. The area of reduced thickness 23 includes a receiving ring 24 and a shoulder 25. Ring 24 and shoulder 25 are concentric with and positioned in fixed spaced relation along the central longitudinal axis. Ring 24 can be a continuous ring or an interrupted ring including two or more ring segments. Alternatively, outer frame 20 can be modified such that device 10 can be readily adapted to interface with any exhalation valve assembly 4 of a mask 2.

Wall 21 can be positioned in this embodiment to protect exhalation valve assembly 4 from damage and contamination and can be formed as a continuous wall or a plurality of side portions at least partially separated by notches 28 as illustrated in the preferred embodiment. Notches 28 permit an increased air flow when face mask 2 is in operational use or in the open position of device 10. At least one tab 26 can be connected to outer frame 20 to aid in manually connecting and removing sealing device 10 from face mask 2.

Cap 30 in this embodiment has a truncated inwardly tapered conical shaped wall 31 extending between the proximal sealing surface 32 and an opposed distal raised central portion or top 39. Wall 31 preferably includes three supporting 34 arms separated by apertures 37 that form passageways for airflow from valve assembly 4. Top 39 and wall 31 provide a structure for transmitting a manually applied force to sealing surface 32 that securely closes exhalation valve 4. In addition, wall 31 functions to protect exhalation valve 4 from impact.

Cap 30 in the open position of sealing device 10 is preferably positioned at least partially within or in proximity to aperture 27 and in spaced relation to face mask 2 and outer frame 20 for the operational use of valve assembly 4 for exhalation. Sealing device 10 in the open position allows sufficient airflow through apertures 27, 37 and notches 28 to permit free flow of exhaled air.

Referring to FIGS. 3-6, flexible link 40 functions as a so called "living hinge" that preferably includes three flexible link elements 42 that flex or bend permitting movement of cap 30 relative to outer frame 20 between the open position and the sealing position of device 10. Flexible link 40 also functions to provide a standoff or spaced separation between frame 20 and cap 30 to permit the free flow of air during normal use.

In the preferred embodiment, each flexible link element 42 is an elongated strip having a gradually tapered radial width from the junction with outer frame 20 to the connection to cap 30. Each link element 42 also preferably has an upward bend 44 in directional orientation from outer frame 20 and a downward turn or bend 44 that extends to connect with cap 30. Each link element 42, extends from the base of a notch 28 upwardly and then arcuately turns downwardly at bend 44 to connect to cap 30 in proximity to sealing surface 32. Flexible links 42 bias cap 30 to maintain, or return to the open position when the manually applied force is released.

The range of flexing or bending of link 40 and the movement of cap 30 between the open position and the sealing position of device 10 can vary depending upon factors, including the construction of a given face mask and the required air flow from the exhalation valve during normal use. Flexible link elements 42 can be of any width that structurally supports the repeated flexible movement of cap 30 between the first and second positions under manual pressure applied by the user. Elements 42 can also include one or more arcuate bends 44 that can vary in thickness or include serrations or notches, for example, that facilitate flexing.

Other designs and configurations of frame 20 and cap 30 can be selected based on aesthetic considerations and/or the configuration of existing face mask and exhalation valve assemblies. Test device 10 of the invention can be utilized to retrofit existing production masks having a rim or collar 7 surrounding the valve flap 5, for example. In these and other applications, sealing device 10 engages the collar 7 for movement between the open position and the sealing position against flap valve 5 or a solid surrounding surface for creation of an airtight seal.

Flexible link 40 can also include link elements 42 that vary in length, width, position and alignment, so that the flexible link 40 bends and/or flexes to pivot, rotate and/or move cap 30 into contact with mask 2 to seal exhalation valve assembly 4 in the closed position. Cap 30 can move along the central longitudinal axis or move independently between the open position and the sealing position.

Figure 6:
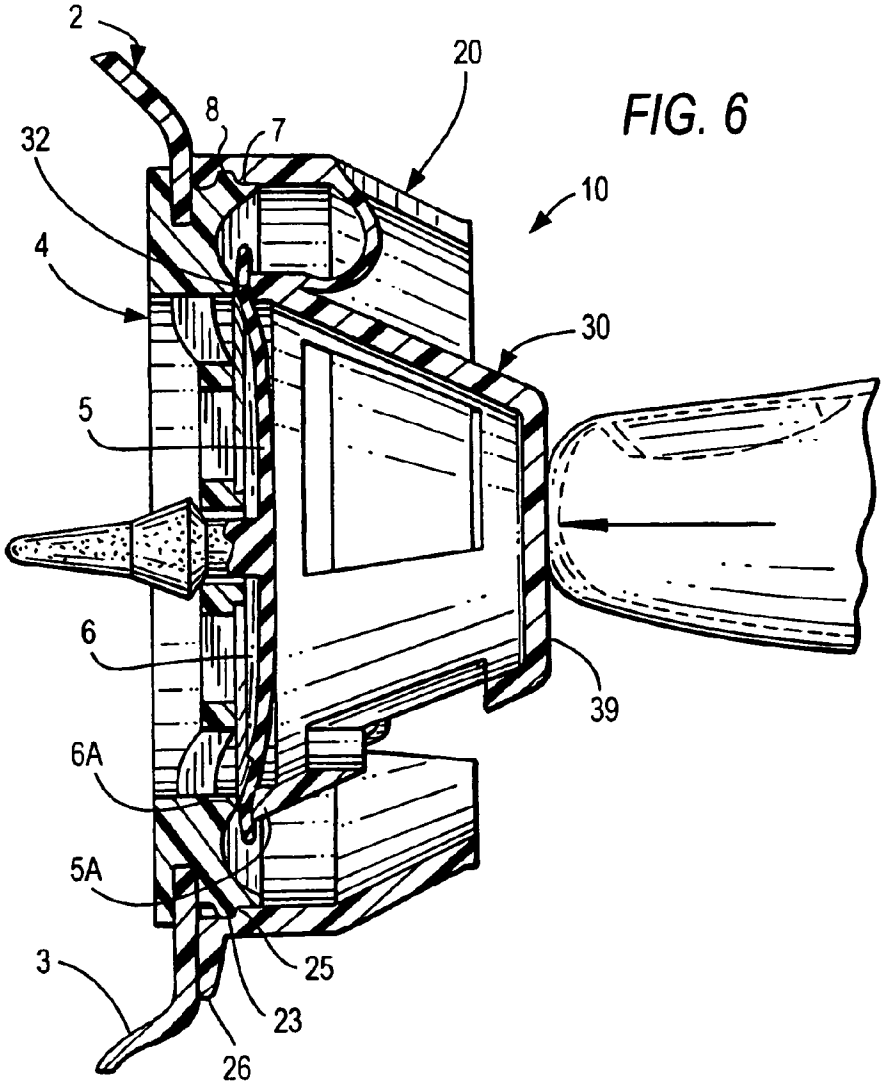
FIG. 6 is a view similar to FIG. 5 showing the cap in the sealing position.
Figure 5:
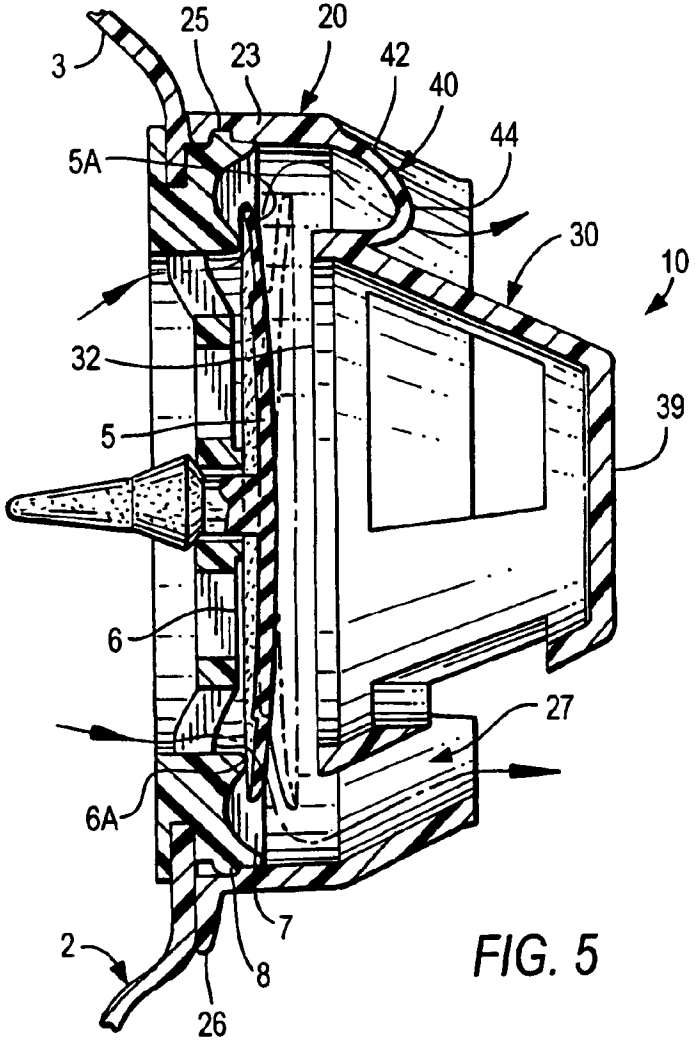
FIG. 5 is a side elevation cross-sectional view of the sealing device and mask of FIG. 1 taken along lines 5-5 in the open position.

Referring now to FIGS. 5 and 6, in this preferred embodiment, flap valve 5 is a flexible member that is positioned on, and centrally connected to valve seat 6. Flap valve 5 is round having a lower or bottom surface for sealing, a top surface and a circular edge. Valve seat 6 defines at least one aperture for the passage of air from the wearer. Flap valve 5 covers and seals the aperture or apertures of valve seat 6 in a closed position and is constructed to flex from the pressure of the exhaled air of the wearer to accommodate the passage of the air through valve assembly 4 when sealing device 10 is in the open position. Flap valve 5 is biased to return to the rest position when the interior mask pressure is insufficient to overcome the force of the bias. Sealing surface 32 of cap 30 has an annular shape in this preferred embodiment that mates with and secures a border area 5A on the top surface and in proximity to the edge of flap valve 5, against a corresponding border area 6A in proximity to the edge of valve seat 6, in the sealing position to close exhalation valve 4.

Referring now to FIGS. 7 and 8, an alternative embodiment of test sealing device 10 is shown connected to face mask 2. Device 10 in this embodiment includes a flexible link 40 having a plurality of adjacent radial flexible link elements 42 connecting frame 20 and cap 30. Frame 20 in this embodiment preferably extends approximately from mask 2 to the face of valve seat 6 and can optionally include notches 28, for example.

Each link element 42 can connect to a portion of frame 20 such as notch 28 and/or upper edge 29 shown in FIG. 2. Elements 42 can also include one or more preformed flexible areas such as bends or hinges 44 that facilitate flexing during movement of cap 30 between the first and second positions of device 10. Each link element 42 biases cap 30 to the first open position. The sealing surface 32 of cap 30 in the second sealing position preferably compresses border area 5A of flap valve 5 against the boarder area 6A of valve seat 6 to seal valve assembly 4.

Referring to FIGS. 9 and 10, another embodiment of test sealing device 10 is shown connected to face mask 2 with flexible link 40 formed as a single continuous annular link member 42 connecting outer frame 20 and cap 30. Flexible link 40 in this embodiment has one or more arcuate or angular accordion folds or bends 44 that permit movement of cap 30 between the open position and the sealed position. Flexible link 40 is biased to the open position and can connect directly with cap 30 or include a support structure 45. Flexible link 40 in this embodiment can also include one or more air passages.

With continuing reference to FIGS. 9 and 10, in another alternative embodiment, cap 30 can have the structure of a disc or plate that extends at least partially over valve seat 6. In this embodiment, sealing surface 32 can be flat or have at least one projection that corresponds to one or more apertures in valve seat 6 so that sealing surface 32 securely seals valve seat 6 of exhalation valve assembly 4 when depressed.

When sealing surface 32 and/or flap valve 5 include projections that correspondingly mate with, and seal each aperture in valve seat 6 to seal valve assembly 4, sealing surface 32 is preferably disc shaped. Alternatively, cap 30 can have a generally hemispherical or cylindrical shape that terminates in sealing surface 32.

In another embodiment of FIGS. 9 and 10, flexible link 40 in the sealing position is positioned to directly contact and seal border area 5A of flap valve 5 against border area 6A of valve seat 6 to seal exhalation valve 4. Alternatively, sealing surface 32 can seal flap valve 5 against the one or more apertures defined in valve seat 6, as described previously independent of or in conjunction with flexible link 40 sealing border areas 5A and 6A. In the first open position of device 10, flexible link 40 is biased to extend outwardly and/or distally from valve assembly 4 in a sufficient manner such that the movement of flap valve 5 is unrestricted.

In operation, as shown in FIGS. 1, 4 and 5, sealing device 10 is connected by a snap fit with face mask 2. Exhalation valve assembly 4 can include collar 7 that interfaces with outer frame 20. Collar 7 has a projecting snap ring 8 that receives ring 24 and shoulder 25 in an area of reduced thickness 23 of frame 20. Ring 24 flexes in conjunction with the area of reduced thickness 23 to allow the passage of projecting snap ring 8 of collar 7 and then secures snap ring 8 between ring 24 and shoulder 25 of outer frame 20. The finger tab 26 can be used to aid in connecting and/or removing sealing device 10 from the face mask 2.

In an alternative embodiment, sealing surface 32 of cap 30 can be brought into position on a shoulder or portion of the flap valve seat 6 beyond the edge of the flap valve 5 to form an airtight seal around the flap valve assembly 4. Resilient material can be provided on sealing surface 32 to enhance the seal in this embodiment. The construction of sealing device 10 is such that outer frame 20, cap 30 and flexible link 40 can be readily adapted for use with almost any type of exhalation valve assembly 4.

Referring now to FIGS. 1, 5 and 6, after face mask 2 is positioned on the head of the wearer and the retaining straps adjusted for fit, sealing device 10 is depressed to test the seal between the head of the wearer and face mask 2. To initiate the test process, the wearer or another individual moves cap 30 by manually pushing top portion 39, against the biasing force of flexible link 40 and relative to outer frame 20 along the central longitudinal axis towards exhalation valve assembly 4. Link member 40 aligns the movement of cap 30 from the open position to the sealing position of device 10 such that sealing surface 32 contacts and seals the border area 5A of flap valve 5 against predefined border area 6A of valve seat 6 to securely close exhalation valve 4.

With exhalation valve 5 sealed, the wearer exhales into the mask thereby creating a substantial positive pressure inside the mask until the pressure overcomes the seal of the mask. If the seal passes the test, the wearer releases cap 30 and the biasing force of the flexible link 40 returns cap 30 to the open position. If the face mask fails the test, as where little pressure build-up occurs because air is escaping from one or more unsealed points, the wearer releases cap 30 and readjusts the fit of mask. The wearer then repeats the test as described above until a successful test is achieved.

It is to be understood that the shape of outer frame 20, including the number, if any, of side portions and notches 28 in wall 21, the shape of cap 30 and number and size of flexible link elements 42, can be varied for specific uses and mask designs. For example, where the mask is worn with heavy or bulky protective clothing and gloves, the size of, and extent to which the exterior portion of cap 30 projects can be increased to assure ease of access for manually depressing the cap for the test. Sealing device 10 is constructed to interface with exhalation valve assembly 4 for the positive pressure testing of the integrity of the seal of the mask 2 with the wearer and to accommodate the passage of the air flow from exhalation valve assembly 4 during normal operational use. Sealing device 10 is described herein as being detachably mounted on the mask, but sealing device 10 can be formed with, and/or permanently attached to the face mask. It is also understood that sealing device 10 can be affixed to exhalation valve assembly 4, by a threaded connection, friction-fit, bayonet or snap-fit type connections.

It is also to be understood that the above embodiments are illustrative and that, for example, any function and/or structure of any one of the embodiments can be combined into the other embodiments disclosed herein and/or performed in a substantially similar way to achieve the desired objectives. As will be apparent to one of ordinary skill in the art, the details of positive pressure sealing device can vary with the type of interface and attachment required for a given exhalation valve assembly and face mask.

We claim:

1. An exhalation valve sealing device for use in manually performing a positive pressure test with a face mask having an exhalation valve assembly that includes a flap valve and a valve seat, said sealing device being molded of a polymeric plastic material, and being comprised of:

a frame attachable to the face mask and defining a central aperture having a generally longitudinal axis;

a movable cap having a generally frustoconical shape, said cap having an inner sealing surface and an opposed disc-shaped top, said inner sealing surface being of a diameter greater than the diameter of said top, said cap being movable in said central aperture in response to a manually applied force from an open position in which said cap is spaced from the exhalation valve assembly to permit normal operational use of the exhalation valve assembly, and a sealing position in which said sealing surface engages and seals the exhalation valve assembly in a closed position; and flexible and resilient link monolithically formed with and joined to said frame and said cap to form a unitary structure, wherein said link supports said cap in the open position and provides a biasing force to return said cap to the open position upon release of the manual force.

2. The sealing device of claim 1, wherein said inner sealing surface of said movable cap is configured and dimensioned to maintain the flap valve against the valve seat in the sealing position.

3. The sealing device of claim 2, wherein said inner sealing surface of said movable cap is configured and dimensioned to seal the peripheral portion of the flap valve against the flap valve seat in the sealing position.

4. The sealing device of claim 3, wherein said flexible link extends from the periphery of said frame to the top portion of the cap.

5. The sealing device of claim 3, wherein said flexible link extends from the periphery of said frame to said inner sealing surface of said movable cap.

6. The sealing device of claim 2, wherein the valve seat includes at least one breath exhalation aperture and said sealing surface of said movable cap configured and dimensioned to seal the flap valve against each aperture in the valve seat.

7. The sealing device of claim 1, wherein said flexible link includes a plurality of spaced-apart flexible link elements.

8. The sealing device of claim 1, wherein said flexible link is a single flexible link element.

9. The sealing device of claim 8, wherein said flexible link includes accordion folds.

10. A face mask including an exhalation valve assembly having a valve seat and an operatively attached positive pressure test sealing device, said sealing device being molded of a polymeric plastic material, and being comprised of:

a frame attached to the face mask and including a wall defining a central aperture with a generally longitudinal axis;

a movable cap having generally frustoconical shape, said cap having an inner sealing surface and an opposed disc-shaped top, said inner sealing surface being of diameter greater than the diameter of said top, said cap being movable in said central aperture in response to a manually applied force to said top between an open position, in which said cap is spaced from the exhalation valve assembly, and a sealing position in which said sealing surface engages and seals the exhalation valve assembly in a closed position; and flexible and resilient link that is monolithically formed with and joined to said frame and said cap to form a unitary structure, wherein said link supports said cap in the open position and provides a biasing force to return said cap to the open position upon release of the manual force.

11. The mask of claim 10, wherein said sealing device is removably attachable to the face mask.

12. The mask of claim 10, wherein said sealing device is fixedly connected to the face mask.

13. The mask of claim 10, wherein said sealing surface is aligned by said flexible link to seal the valve seat of the exhalation valve assembly in said sealing position.

14. The mask of claim 13, wherein the valve seat includes at least one aperture and said sealing surface seals a flap valve to close each aperture in the valve seat.

15. The sealing device of claim 13, wherein said sealing surface seals the periphery of a flap valve against the periphery of the valve seat in said sealing position.

16. The sealing device of claim 13, wherein said sealing surface contacts a portion of the valve seat in said sealing position.

17. A method of positive pressure testing a respirator face mask having an exhalation valve assembly and an operatively attached test sealing device that includes as a structure, a cap connected to a frame by a flexible link which is monolithically molded therewith of a polymeric flexible and resilient plastic material, said cap having a sealing surface, said flexible link being capable of resiliently flexing in response to a manually applied force to move said cap relative to said frame toward the exhalation valve assembly, and returning said cap to the open position by a resilient return bias force when the manually applied force is removed, the method comprising the steps of:

positioning the face mask on the head of a wearer and adjusting the face mask for fit;

moving said cap from an open position to a sealing position by manually depressing said cap to move said sealing surface against the exhalation valve assembly to maintain the valve assembly in a closed position; and exhaling into the face mask while maintaining the sealing device in the sealing position to test the seal of the mask on the wearer's face.

18. The method of claim 17, wherein said operatively attached sealing device and exhaust valve assembly are aligned along a longitudinal axis, and said cap moves along the axis.

19. The method of claim 17, wherein the exhalation valve assembly has a flap valve and a valve seat, and said cap is moved to position said sealing surface against the flap valve.

20. The method of claim 17, wherein the step of moving said cap to said sealing position includes pressing said sealing surface against the exhalation valve assembly.

21. The method of claim 17 which further includes the step of manually releasing said cap after the exhalation test, whereby said sealing device is returned to the open position by the biasing action of said flexible link.

22. An exhalation valve sealing device for use in manually performing a positive pressure test with a face mask having an exhalation valve assembly that includes a flap valve and a valve seat, said valve sealing device being molded of a flexible and resilient plastic material to form a monolithic structure, which comprises:

a generally circular shaped frame having attachment devices for attachment of said frame to the face mask over the exhalation valve, said frame defining a central aperture having a generally longitudinal axis;

a movable cap having a generally frustoconical shape, said cap having a generally circular inner sealing surface and an opposed disc-shaped top, said inner sealing surface being of a diameter greater than the diameter of said disc-shaped top, said cap being movable in said central aperture of said frame in response to a manually applied force from a first open position spaced from the exhalation valve to a second sealing position in engagement with the exhalation valve, to selectively seal the exhalation valve and prevent passage of gases therethrough; and flexible and resilient link monolithically formed with and joined to said frame and said cap to form a unitary structure, wherein said link supports said cap in said first open position and said second sealing position, and provides a biasing force to return said cap to said open position upon release of the manual force.

* * * * *

UNITED STATES PATENT AND TRADEMARK OFFICE

CERTIFICATE OF CORRECTION

PATENT NO. : 8,443,806 B2
APPLICATION NO. : 11/992795
DATED : May 21, 2013
INVENTOR(S) : Morelli et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1590 days.

Signed and Sealed this
Eighth Day of September, 2015

Michelle K. Lee

Michelle K. Lee
*Director of the United States Patent and Trademark Office*